United States Patent [19]

Sweet

[11] 4,235,041

[45] Nov. 25, 1980

[54] FIGURE TOY

[75] Inventor: Roger H. Sweet, Long Beach, Calif.

[73] Assignee: Mattel, Inc., Hawthorne, Calif.

[21] Appl. No.: 13,855

[22] Filed: Feb. 22, 1979

[51] Int. Cl.[3] ..... A63H 13/00

[52] U.S. Cl. ..... 46/115; 46/151; 248/206 R

[58] Field of Search ..... 46/116, 115, 151, 152, 46/156, 162, 153, 1 R; 248/363, 362, 206 R; 206/77.1; 273/DIG. 25

[56] References Cited

U.S. PATENT DOCUMENTS

| | | | |
|---|---|---|---|
| 1,710,989 | 4/1929 | Kelly | 46/116 UX |
| 2,219,130 | 10/1940 | Herrmann | 46/162 X |
| 2,734,765 | 2/1956 | Henderson et al. | 428/31 X |
| 3,101,566 | 8/1963 | Stiller | 248/362 X |

FOREIGN PATENT DOCUMENTS

| | | | |
|---|---|---|---|
| 523823 | 4/1956 | Canada | 46/115 |
| 1047831 | 11/1966 | United Kingdom | 46/115 |

*Primary Examiner*—Gene Mancene
*Assistant Examiner*—Mickey Yu
*Attorney, Agent, or Firm*—John G. Mesaros; Ronald M. Goldman; Max E. Shirk

[57] ABSTRACT

A figure toy having appendages of a soft plastic. The toy is covered front and back on its body and appendages with suction cups so that it will adhere to various smooth surfaces at its front, back, and appendages.

8 Claims, 4 Drawing Figures

23
22

28
4.
14
20
10
16
24
12
3.

28
29

22
14
20
16
12
26
24
18
10

FIGURE TOY

BACKGROUND OF THE INVENTION

The background of the invention will be discussed in two parts:

1.Field of the Invention

This invention relates to a figure toy and, more particularly to a figure toy having a plurality of suction cup members which are capable of causing such toy to adhere to smooth surfaces.

2. Description of the Prior Art

There have been many figure toys which have been popular with children. Many of these toys have parts such as arms and legs which may be moved to make the toys pose in various positions. Recently, figure toys have appeared which depict characters portrayed on television or in the movies who are purported to have extraordinary superhuman characteristics. Unfortunately, the figure toys are often unable to convey such characteristics to the children; and they are simply posed in position where it is hoped that the imagination of the child will take over and furnish the particular extraordinary characteristic of the toys.

Various attempts have been made to provide the extraordinary characteristics of the toys themselves. For example, toys have been devised which throw balls, swing bats, engage in karate, and perform like exercises. However, none of these characteristics appears to be beyond the capabilities of a human; and the imagination must still be relied upon to provide the extraordinary characteristics.

It is an object of the present invention to provide a figure toy which embodies various extraordinary properties.

It is another object of the present invention to provide a figure toy which is capable of adhering to various smooth vertical surfaces and objects.

It is a further object of the invention to provide a new figure toy having bendable arms and legs and being covered with suction cups in such manner that the toy may be made to adhere to various smooth surfaces.

SUMMARY OF THE INVENTION

The foregoing and other objects of the invention are accomplished by a figure toy having a body, two arms, two legs and a head. The toy may be made with a hard plastic body and may be made posable; or, alternatively, the body may be made of a soft plastic. In either case, the arms thereof are quite long and are made of a soft plastic such as vinyl. Integrally molded to the arms and to the body are suction cups. The suction cups are positioned so that they lie, essentially, in a first plane along the front of a body and along a second plane to the rear of the body. By providing suction cups facing in a plane to the front and in a plane to the rear, the figure has a very strong grip for any smooth surface against which it may be pressed such as a wall, a sheet of glass, or the like. Consequently, it may be thrown against a smooth surface and will adhere thereto. Because its arms are soft and bendable, the figure may be wrapped around various smooth objects and will grip them tightly. The figure may also be provided with suction cups on its feet and on the top of its head.

Since the figure is capable of adhering to smooth surfaces against which it is thrown and will adhere to smooth toys, it will display in play certain of the extraordinary characteristics often associated with the characters which appear on television or in the movies without an excessive need for imagination.

Other objects, features and advantages of the invention will become apparent from a reading of the specification taken in conjunction with the drawings in which like reference numerals refer to like elements in the several views.

DESCRIPTION OF THE PREFERRED EMBODIMENT

Figures 1, 2, 3, 4:
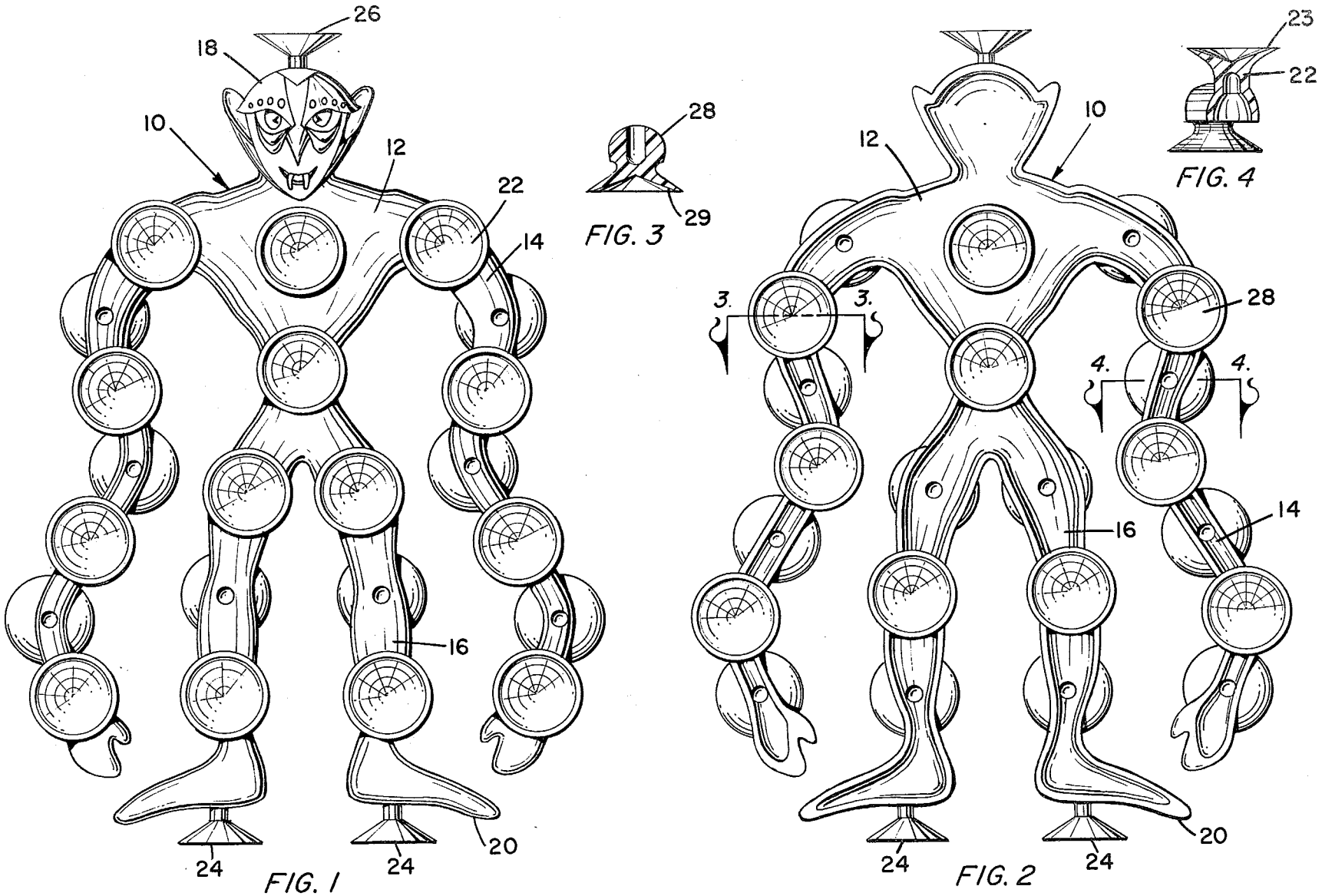
FIG. 1 is a front view of a figure toy constructed in accordance with the invention.
FIG. 2 is a back view of the figure toy shown in FIG. 1.
FIG. 3 is a cross-sectional view taken along section line 3—3 of FIG. 2 showing one of the rearward facing suction cups.
FIG. 4 is a cross-sectional view taken along the section line 4—4 of FIG. 2 showing one of the frontward facing suction cups.

Referring now to the drawings and, more particularly, to FIG. 1, there is shown a front view of a figure toy 10 constructed in accordance with the invention. The figure toy 10 has a body 12, a pair of arms 14, a pair of legs 16, a head 18 and a pair of feet 20. Although the body 12 may in another embodiment (not shown) be constructed of a hard plastic material and may have various bendable or posable parts, the body shown in FIG. 1 is preferably constructed of a soft plastic material such as a soft vinyl having sufficient structural strength to hold it in the upright position but soft enough so that it may be bent around various objects. The arms 14, the legs 16, the head 18, and the feet 20 are integrally molded in a well known manner with the body 12, in the preferred embodiment, from the same soft plastic material. Consequently, the arms 14 and the legs 16 may easily wrap around other objects.

The front of the body 12, the arms 14 and the legs 16 are all covered with a number of suction cups 22 having their frontal surfaces 23 (See FIG. 3) lying generally in the same plane. The suction cups 22 may be integrally molded with the body 12 and are so positioned that when the body 12 is pressed against a smooth surface such as plate of glass, the toy figure 10 will adhere thereto. The large number of suction cups 22 in the particular plane assures the very strong adherence of the toy 10. The plurality of suction cups 22 on each arm 14 and leg 16 allow these extremities to adhere individually to various smooth surfaces. The feet 20 also mount a pair of suction cups 24, and a single suction cup 26 is mounted to the upper portion of the head 18. The latter suction cups 24 and 26 provide that the toy 10 may be positioned in the upright position on a smooth surface or may be made to adhere to a smooth overhead surface. Alternatively, the toy 10 may be stood upon its head by the suction cup 26, or the suction cups 24 may be stuck to a smooth overhead surface so that the toy 10 will hang from its feet.

FIG. 2 illustrates a back view of the toy 10 with the body 12, the arms 14 and the legs 16. A second set of suction cups 28 are affixed to the arms 14, legs 16, and body 12 facing backward. The suction cups 28 also have an outer surface 29 all of which lie in a single plane so that the back of the toy 10 may be made to adhere strongly to a smooth surface.

FIG. 3 shows a cross section taken along the section line 3—3 of FIG. 2 and illustrates a particular rearward-facing suction cup 28. FIG. 4 shows another cross section taken along the section line 4—4 and illustrates a single front-facing suction cup 22. The form of the particular body sections may be noted by viewing FIGS. 3 and 4. The arms 14 shown in each of these FIGS. 3 and 4 have a smooth rounded outer surface facing forward and an essentially hollow rearward-facing surface. This facilitates the bending of the arms 14 and allows them to be positioned about various smooth items to which they will adhere.

In use, the toy 10 may have an arm 14, a leg 16, or its body 12 pressed against a smooth surface and because of the plurality of suction cups provided will adhere thereto. This is true whether the surface is vertical, overhead, or at some other angle. The toy 10 may also be affixed by its head or feet as explained above. Thus, the toy 10 will assume various play positions which are extraordinary. Furthermore, the toy 10 may be made to adhere to other smooth objects, e.g., another toy, bending and wrapping its arms or legs around the other object. The toy 10 because of its large total gripping surface in a particular plane may even be made to adhere to one smooth surface while gripping and supporting a second smooth object; all of these possibilities give the toy exceptional play value and enhance its extraordinary characteristics in the eyes of a child.

It will be obvious that the figure toy 10 made in accordance with the invention will provide in and of itself those extraordinary characteristics which are normally not available in figure toys but which must be imagined by children.

While there has been shown and described a preferred embodiment, it is to be understood that various other adaptations and modifications may be made within the spirit and scope of the invention.

What is claimed is:

1. A figure toy having a body;
a head, and at least one appendage defining front and back surfaces; and
a plurality of suction cups affixed to at least both the front and back surfaces.

2. A figure toy as claimed in claim 1 in which the appendage is manufactured of a soft plastic.

3. A figure toy as claimed in claim 1 having a suction cup affixed to the head.

4. A figure toy as claimed in claim 1 having a suction cup affixed to the end of the appendage.

5. A figure toy as claimed in claim 1 wherein the appendage is an arm, further comprising a second arm and two legs, and in which the body, arms, and legs are molded in a single piece from a soft plastic material.

6. A figure toy comprising a body, a head, two arms, two legs, two feet, and a plurality of suction cups affixed to both the front and back surfaces of said arms and legs, all parts thereof being molded as a single unitary structure.

7. A figure toy as claimed in claim 6 in which the suction cups have their adhering surfaces lying in a frontal plane and a back plane.

8. A figure toy as claimed in claim 7 having suction cups affixed to the head and to the two feet.

* * * * *